US011308876B2

(12) United States Patent
Liu et al.

(10) Patent No.: US 11,308,876 B2
(45) Date of Patent: Apr. 19, 2022

(54) PIXEL DRIVING CIRCUIT, DRIVING METHOD THEREOF AND DISPLAY DEVICE

(71) Applicant: BOE TECHNOLOGY GROUP CO., LTD., Beijing (CN)

(72) Inventors: Dongni Liu, Beijing (CN); Minghua Xuan, Beijing (CN); Xiaochuan Chen, Beijing (CN); Lei Wang, Beijing (CN); Zheng Fang, Beijing (CN); Li Xiao, Beijing (CN); Liang Chen, Beijing (CN); Shengji Yang, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 406 days.

(21) Appl. No.: 16/491,547

(22) PCT Filed: Mar. 28, 2019

(86) PCT No.: PCT/CN2019/080023
§ 371 (c)(1),
(2) Date: Sep. 5, 2019

(87) PCT Pub. No.: WO2019/223422
PCT Pub. Date: Nov. 28, 2019

(65) Prior Publication Data

US 2021/0366389 A1 Nov. 25, 2021

(30) Foreign Application Priority Data

May 21, 2018 (CN) ..... 201810487363.0

(51) Int. Cl.
*G09G 3/3233* (2016.01)

(52) U.S. Cl.
CPC ... *G09G 3/3233* (2013.01); *G09G 2300/0421* (2013.01); *G09G 2300/0809* (2013.01); *G09G 2320/0233* (2013.01); *G09G 2320/0257* (2013.01); *G09G 2330/02* (2013.01)

(58) Field of Classification Search
CPC ..... G09G 3/3233
USPC ..... 345/212
See application file for complete search history.

(56) References Cited

U.S. PATENT DOCUMENTS

| | | | | |
|---|---|---|---|---|
| 9,799,270 | B2 * | 10/2017 | Li | G09G 3/3258 |
| 10,140,923 | B2 * | 11/2018 | Wang | G09G 3/3233 |
| 10,210,803 | B2 * | 2/2019 | Wu | G09G 3/3233 |
| 10,818,226 | B2 * | 10/2020 | Ding | H01L 27/14609 |
| 2018/0286313 | A1 * | 10/2018 | Zheng | G09G 3/3258 |

* cited by examiner

*Primary Examiner* — Calvin C Ma
(74) *Attorney, Agent, or Firm* — Womble Bond Dickinson (US) LLP

(57) ABSTRACT

A pixel driving circuit including: N pixel circuits each including a first node and a power supply terminal, N being an integer greater than 1; and N multiplexing circuits configured to selectively couple a data line to the first nodes of the N pixel circuits. A first one of the N multiplexing circuits includes a multiplexing control circuit, and a second one to an N-th one of the N multiplexing circuits include respective multiplexing control circuits and respective reset circuits. The reset circuit of a (j+1)-th one of the N multiplexing circuits is configured to reset the first node of a (j+1)-th one of the N pixel circuits with a power supply voltage in response to a j-th multiplexing control signal being active, j being an integer and 1≤j<N.

20 Claims, 4 Drawing Sheets

PIXEL DRIVING CIRCUIT, DRIVING METHOD THEREOF AND DISPLAY DEVICE

CROSS-REFERENCE TO RELATED APPLICATIONS

The present application is a 35 U.S.C. 371 national stage application of PCT International Application No. PCT/CN2019/080023, filed on Mar. 28, 2019, which claims priority to Chinese Patent Application No. 201810487363.0, filed on May 21, 2018, the entire disclosures of which are incorporated herein by reference.

TECHNICAL FIELD

The present disclosure relates to the field of display technologies, and in particular, to a pixel driving circuit, a method of driving the pixel driving circuit, and a display device.

BACKGROUND

A pixel of an organic light emitting diode (OLED) display device includes an organic electroluminescent diode which is a current-driven type of light-emitting device. When in use, the OLED display device often suffers from defects such as artifacts. For example, after displaying a black-and-white checkerboard image for a while, the OLED display device may display an artifact if it is switched to display an image of a certain grayscale.

SUMMARY

According to some embodiments of the present disclosure, a pixel driving circuit is provided which comprises: N pixel circuits, each of the pixel circuits comprising a first node and a power supply terminal, the first node configured to receive a data voltage, the power supply terminal configured to receive a power supply voltage, wherein N is an integer greater than 1; and N multiplexing circuits configured to selectively couple a data line to the first nodes of the N pixel circuits, wherein a first one of the N multiplexing circuits comprises a multiplexing control circuit, and a second one to an N-th one of the N multiplexing circuits comprise respective multiplexing control circuits and respective reset circuits. The multiplexing control circuit of an i-th one of the N multiplexing circuits is configured to couple the data line to the first node of an i-th one of the N pixel circuits in response to an i-th multiplexing control signal being active, i being an integer and $1 \leq i \leq N$. The reset circuit of a (j+1)-th one of the N multiplexing circuits is configured to reset the first node of a (j+1)-th one of the N pixel circuits with the power supply voltage in response to a j-th multiplexing control signal being active, j being an integer and $1 \leq j < N$.

In some embodiments, the multiplexing control circuits of the N multiplexing circuits are configured such that the data line is sequentially coupled to the first nodes of the N pixel circuits.

In some embodiments, the multiplexing control circuit of the i-th one of the N multiplexing circuits comprises a first transistor comprising: a control electrode configured to receive the i-th multiplexing control signal; a first electrode connected to the data line; and a second electrode connected to the first node of the i-th one of the N pixel circuits.

In some embodiments, the reset circuit of the (j+1)-th one of the N multiplexing circuits comprises a second transistor comprising: a control electrode configured to receive the j-th multiplexing control signal; a first electrode connected to the first node of the (j+1)-th one of the N pixel circuits; and a second electrode connected to the power supply terminal of the (j+1)-th one of the N pixel circuits.

In some embodiments, each of the N pixel circuits comprises a compensation sub-circuit, a driving sub-circuit, a light emission control sub-circuit, a reset sub-circuit, and a light emission sub-circuit. The reset sub-circuit is configured to reset the driving sub-circuit and the light emission sub-circuit with a reset voltage in response to a first scan signal being active during a reset phase. The compensation sub-circuit is configured to transfer the data voltage at the first node to the driving sub-circuit in response to a second scan signal being active during a compensation phase. The driving sub-circuit is configured to generate a driving current during a light emission phase, the driving current having a magnitude related to the data voltage. The light emission control sub-circuit is configured to direct the driving current to the light emission sub-circuit in response to a first light emission control signal and a second light emission control signal being active during the light emission phase. The light emission sub-circuit is configured to emit light in response to the driving current flowing therethrough during the light emission phase.

In some embodiments, the light emission sub-circuit comprises an organic light emitting diode comprising an anode configured to receive the driving current and a cathode configured to receive a ground voltage.

In some embodiments, the driving sub-circuit comprises a driving transistor comprising a control electrode, a first electrode and a second electrode.

In some embodiments, the compensation sub-circuit comprises: a third transistor comprising a control electrode configured to receive the second scan signal, a first electrode connected to the second electrode of the driving transistor, and a second electrode connected to the control electrode of the driving transistor; a fourth transistor comprising a control electrode configured to receive the second scan signal, a first electrode connected to the first node, and a second electrode connected to the first electrode of the driving transistor; and a first capacitor connected between the power supply terminal and the control electrode of the driving transistor.

In some embodiments, the light emission control sub-circuit comprises: a fifth transistor comprising a control electrode configured to receive the second light emission control signal, a first electrode connected to the power supply terminal, and a second electrode connected to the first electrode of the driving transistor; and a sixth transistor comprising a control electrode configured to receive the first light emission control signal, a first electrode connected to the second electrode of the driving transistor, and a second electrode connected to the anode of the organic light emitting diode.

In some embodiments, the reset sub-circuit comprises: a seventh transistor comprising a control electrode configured to receive the first scan signal, a first electrode connected to the control electrode of the driving transistor, and a second electrode configured to receive the reset voltage; and an eighth transistor comprising a control electrode configured to receive the first scan signal, a first electrode configured to receive the reset voltage, and a second electrode connected to the anode of the organic light emitting diode.

According to some embodiments of the present disclosure, a display device is provided which comprises a plurality of the pixel driving circuits as described above.

According to some embodiments of the present disclosure, a method of driving a pixel driving circuit is provided. The pixel driving circuit comprises: N pixel circuits, each of the pixel circuits comprising a first node and a power supply terminal, the first node configured to receive a data voltage, the power supply terminal configured to receive a power supply voltage, wherein N is an integer greater than 1; and N multiplexing circuits configured to selectively couple a data line to the first nodes of the N pixel circuits, wherein a first one of the N multiplexing circuits comprises a multiplexing control circuit, and a second one to an N-th one of the N multiplexing circuits comprise respective multiplexing control circuits and respective reset circuits, wherein the multiplexing control circuit of an i-th one of the N multiplexing circuits is configured to couple the data line to the first node of an i-th one of the N pixel circuits in response to an i-th multiplexing control signal being active, i being an integer and $1 \leq i \leq N$. The reset circuit of a (j+1)-th one of the N multiplexing circuits is configured to reset the first node of a (j+1)-th one of the N pixel circuits with the power supply voltage in response to a j-th multiplexing control signal being active, j being an integer and $1 \leq j < N$. The method comprises supplying the j-th multiplexing control signal that is active to the multiplexing control circuit of a j-th one of the N multiplexing circuits such that the data voltage on the data line is transferred to the first node of a j-th one of the N pixel circuits, and that the first node of the (j+1)-th one of the N pixel circuits is reset to the power supply voltage.

In some embodiments, each of the N pixel circuits comprises a compensation sub-circuit, a driving sub-circuit, a light emission control sub-circuit, a reset sub-circuit, and a light emission sub-circuit. The method further comprises: performing a reset phase in which the reset sub-circuit resets the driving sub-circuit and the light emission sub-circuit with a reset voltage; performing a compensation phase in which the compensation sub-circuit transfers the data voltage at the first node to the driving sub-circuit; and performing a light emission phase in which the driving sub-circuit generates a driving current having a magnitude related to the data voltage, the light emission control sub-circuit directs the driving current to the light emission sub-circuit, and the light emission sub-circuit emits light in response to the driving current flowing therethrough. The supplying of the j-th multiplexing control signal that is active to the multiplexing control circuit of the j-th one of the N multiplex circuits is performed in the compensation phase.

In some embodiments, the performing the compensation phase further comprises sequentially coupling, by the multiplexing control circuits of the N multiplexing circuits, the data line to the first nodes of the N pixel circuits such that respective data voltages are sequentially transferred to the driving sub-circuits of the N pixel circuits.

In some embodiments, in the reset phase, the reset sub-circuits of the N pixel circuits simultaneously reset the driving sub-circuits and the light emission sub-circuits of the N pixel circuits; and in the light emission phase, the light emission control sub-circuits of the N pixel circuits simultaneously direct respective driving currents to the light emission sub-circuits of the N pixel circuits such that the light emission sub-circuits simultaneously emit light.

These and other aspects of the present disclosure will be apparent from and elucidated with reference to the embodiment(s) described hereinafter.

Figure 1:
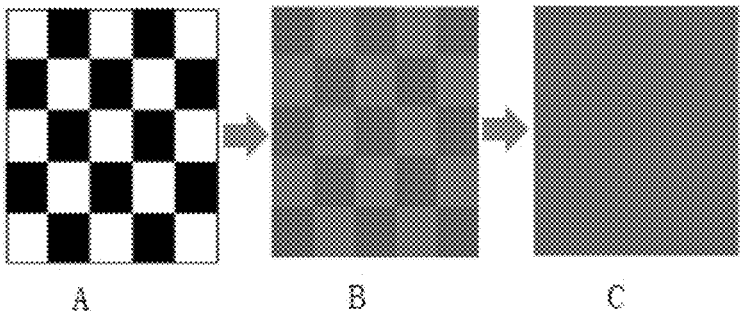
FIG. 1 is a schematic diagram showing an artifact occurring on a display device in the related art.

In the drawings, the same reference signs denote the same elements throughout. The same reference numerals may be assigned with different suffixes to indicate different instances of the same element, and when reference is made to the reference numeral only, any one of the different instances of the element is referred to.

DETAILED DESCRIPTION

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "connected to" or "coupled to" another element or layer, it can be directly connected or coupled to another element or layer, or intervening elements or layers may be present. In contrast, when an element is referred to as being "directly connected to" or "directly coupled to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a schematic diagram showing an artifact occurring on a display device in the related art. As shown in FIG. 1, after a black-and-white checkerboard image A is displayed for 10 s, the display device is switched to display an image C of 48 grayscales, and an artifact B appears when the image A transitions to the image C. In some cases, it may take tens of seconds for the artifact B to disappear.

Applicants have recognized that the appearance of the artifact is related to a hysteresis effect of the driving transistors in the OLED pixel circuits. When switching between different images, the gate-source voltages Vgs of the driving transistors in different pixels are different in an initialization phase, resulting in a difference in luminance at the beginning of the image switching process.

Figure 2:
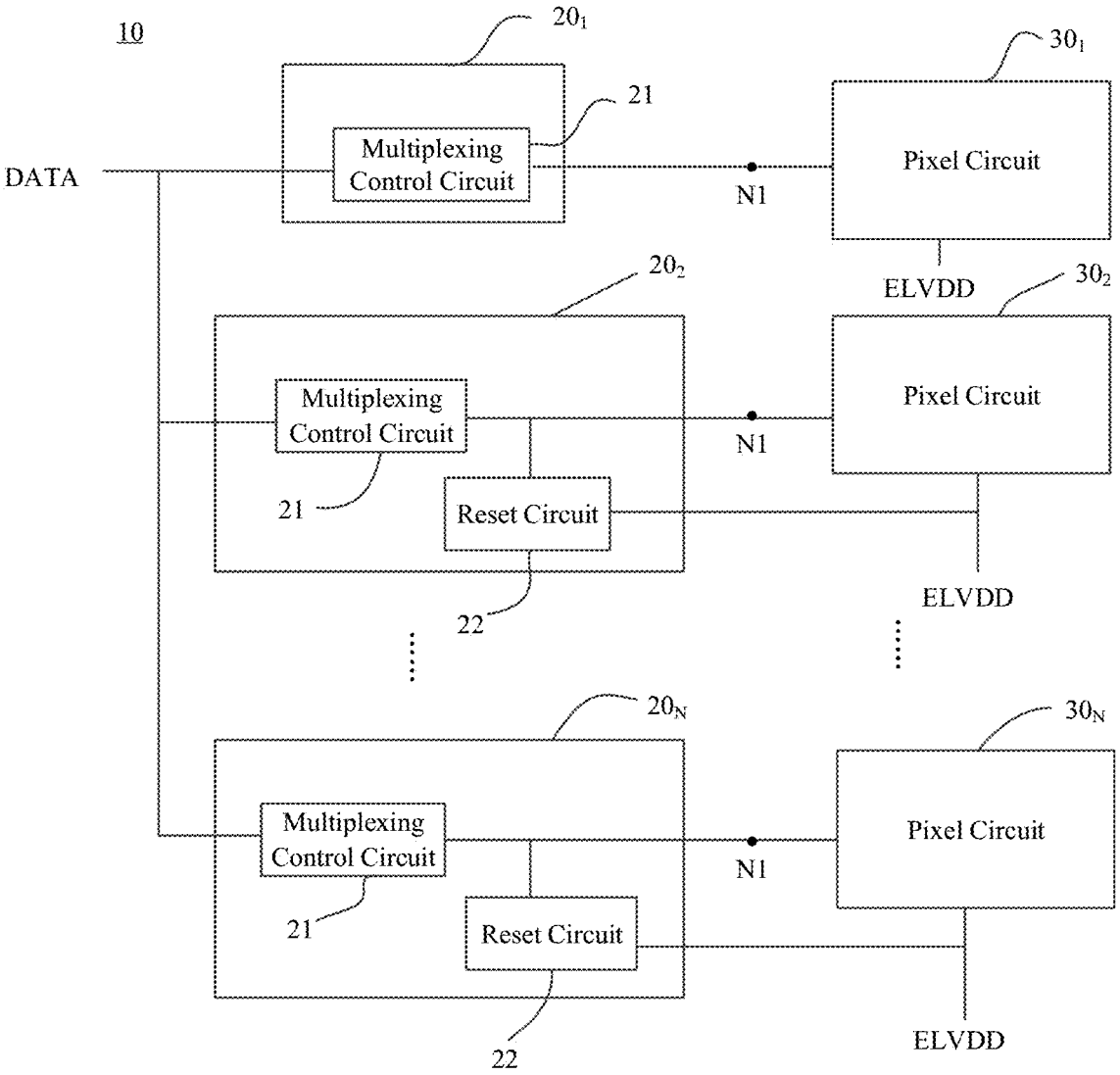
FIG. 2 is a schematic block diagram of a pixel driving circuit in accordance with an embodiment of the present disclosure.

FIG. 2 is a schematic block diagram of a pixel driving circuit 10 in accordance with an embodiment of the present disclosure. As shown in FIG. 2, the pixel driving circuit 10 includes N multiplexing circuits $\mathbf{20}_1$, $\mathbf{20}_2$, . . . $\mathbf{20}_N$ and N pixel circuits $\mathbf{30}_1$, $\mathbf{30}_2$, . . . $\mathbf{30}_N$, where N is an integer greater than 1.

Each of the N pixel circuits $\mathbf{30}_1$, $\mathbf{30}_2$, . . . $\mathbf{30}_N$ includes a first node N1 configured to receive a data voltage and a power supply terminal ELVDD configured to receive a power supply voltage. In the present embodiment, the pixel circuit may be an OLED pixel, although other embodiments are possible.

The N multiplexing circuits $\mathbf{20}_1$, $\mathbf{20}_2$, . . . $\mathbf{20}_N$ are configured to selectively couple a data line DATA to the first nodes N1 of the N pixel circuits $\mathbf{30}_1$, $\mathbf{30}_2$, . . . $\mathbf{30}_N$. The first one $\mathbf{20}_1$ of the N multiplexing circuits $\mathbf{20}_1$, $\mathbf{20}_2$, . . . $\mathbf{20}_N$ includes a multiplexing control circuit 21, and the second one to the N-th one $\mathbf{20}_2$, . . . $\mathbf{20}_N$ of the N multiplexing circuits $\mathbf{20}_1$, $\mathbf{20}_2$, . . . $\mathbf{20}_N$ each include respective multiplexing control circuits 21 and respective reset circuits 22.

The multiplexing control circuit 21 of the i-th one of the N multiplexing circuits $\mathbf{20}_1$, $\mathbf{20}_2$, . . . $\mathbf{20}_N$ is configured to couple the data line DATA to the first node N1 of the i-th one of the N pixel circuits $\mathbf{30}_1$, $\mathbf{30}_2$, . . . $\mathbf{30}_N$ in response to an i-th multiplexing control signal (not shown) being active, i being an integer and $1 \leq i \leq N$.

The reset circuit 22 of the (j+1)-th one of the N multiplexing circuits $\mathbf{20}_1$, $\mathbf{20}_2$, . . . $\mathbf{20}_N$ is configured to reset the first node N1 of the (j+1)-th one of the N pixel circuits $\mathbf{30}_1$, $\mathbf{30}_2$, . . . $\mathbf{30}_N$ with the power supply voltage in response to a j-th multiplexing control signal (not shown) being active, j being an integer and $1 \leq j < N$.

The multiplexing control circuits 21 of the N multiplexing circuits $\mathbf{20}_1$, $\mathbf{20}_2$, . . . $\mathbf{20}_N$ may be configured such that the data line DATA is sequentially coupled to the first nodes N1 of the N pixel circuits $\mathbf{30}_1$, $\mathbf{30}_2$, . . . $\mathbf{30}_N$. That is, the data line DATA is shared by the N pixel circuits $\mathbf{30}_1$, $\mathbf{30}_2$, . . . $\mathbf{30}_N$. This is advantageous in that the data lines and data driving chips required in the display device can be reduced and the cost can be lowered.

Further, when the i-th multiplexing circuit 20 transfers the data voltage on the data line DATA to the i-th pixel circuit 30, the reset circuit 22 in the (i+1)-th multiplexing circuit 20 resets the first node N1 of the (i+1)-th pixel circuit 30 with the power supply voltage received at the power supply terminal ELVDD. As will be described in more detail later, this may allow the driving transistor in the (i+1)-th pixel circuit 30 to have a definite gate-source voltage Vgs prior to data writing, which facilitates mitigation or alleviation of the artifact problem when the display device switches between images.

It will be understood that in FIG. 2, although the N multiplexing circuits $\mathbf{20}_1$, $\mathbf{20}_2$, . . . $\mathbf{20}_N$ and the N pixel circuits $\mathbf{30}_1$, $\mathbf{30}_2$, . . . $\mathbf{30}_N$ are shown as arranged in a spatial order, this is merely illustrative. In other embodiments, they may be arranged in any other suitable order. Accordingly, the terms first, second to N-th, i-th, and (j+1)-th as used herein do not imply any spatial order, but are used for the purpose of distinguishing different elements.

Figure 3:
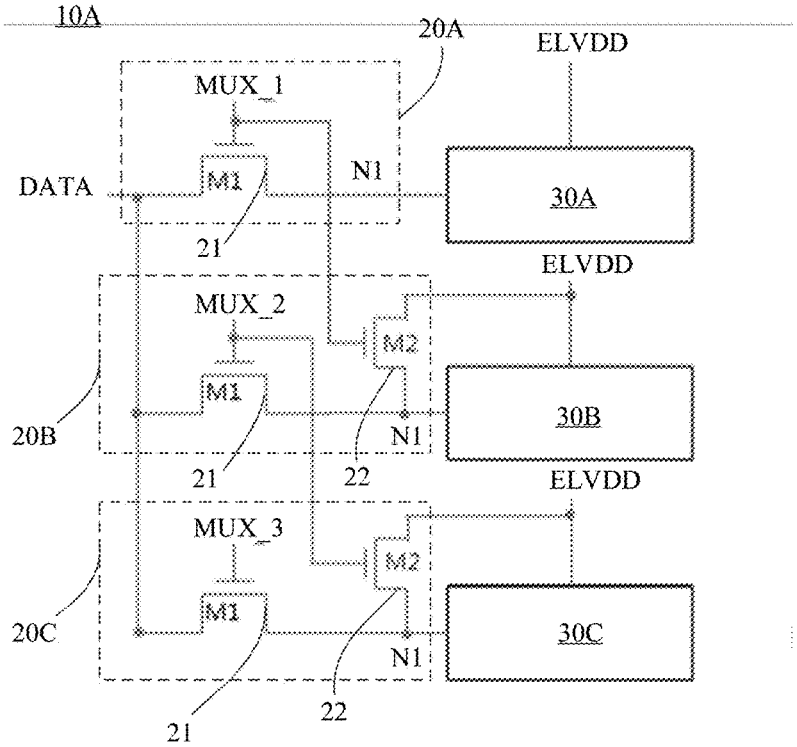
FIG. 3 is a schematic diagram of an example pixel driving circuit including three multiplexing circuits and three pixel circuits, in accordance with an embodiment of the present disclosure.

FIG. 3 shows a schematic diagram of an example pixel driving circuit 10A including three multiplexing circuits 20A, 20B, and 20C and three pixel circuits 30A, 30B, and 30C.

In this example, the multiplexing control circuit 21 of the multiplexing circuits 20A, 20B, and 20C includes respective first transistors M1. Each of the first transistors M1 includes a control electrode configured to receive a respective one of multiplexing control signals MUX_1, MUX_2, and MUX_3, a first electrode connected to the data line DATA, and a second electrode connected to the first node N1 of a respective one of the pixel circuits 30A, 30B and 30C.

In this example, the reset circuits 22 in the multiplexing circuits 20B and 20C include respective second transistors M2. Each of the second transistors M2 includes a control electrode configured to receive a respective one of the multiplexing control signals MUX_1 and MUX_2, a first electrode connected to the first node N1 of a respective one of the pixel circuits 30B and 30C, and a second electrode connected to the power supply terminal ELVDD of a respective one of the pixel circuits 30B and 30C.

Figure 4:
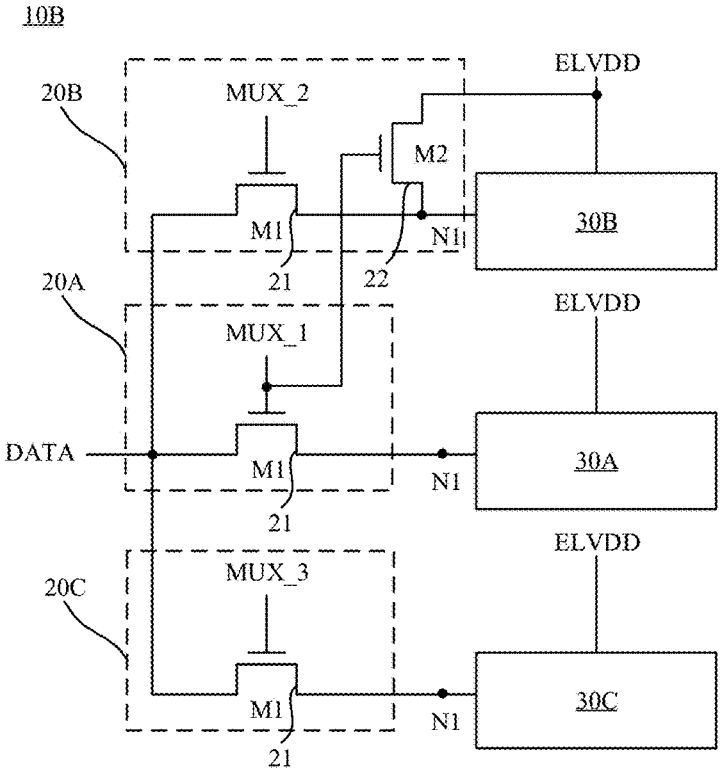
FIG. 4 shows an example variation of the pixel driving circuit of FIG. 3.

FIG. 4 shows an example variation 10B of the pixel driving circuit 10A. The pixel driving circuit 10B also includes three multiplexing circuits 20A, 20B, and 20C and three pixel circuits 30A, 30B, and 30C.

The multiplexing control circuits 21 of the multiplexing circuits 20A, 20B, and 20C includes respective first transistors M1. Each of the first transistors M1 includes a control electrode configured to receive a respective one of the multiplexing control signals MUX_1, MUX_2, and MUX_3, a first electrode connected to the data line DATA, and a second electrode connected to the first node N1 of a respective one of the pixel circuits 30A, 30B and 30C. The multiplexing circuits 20A, 20B, and 20C and the pixel circuits 30A, 30B, and 30C are arranged in the pixel driving circuit 10B in a different spatial order than in the pixel driving circuit 10A.

The reset circuit 22 in the multiplexing circuit 20B includes a second transistor M2. The second transistor M2 includes a control electrode configured to receive the multiplexing control signal MUX_1, a first electrode connected to the first node N1 of the pixel circuit 30B, and a second electrode connected to the power supply terminal ELVDD of the pixel circuit 30B. Compared with the pixel driving circuit 10A, in the present example, the reset circuit 22 in the multiplexing circuit 20C does not include the second transistor M2. This still conforms to the concept of the present disclosure because the first node N1 of the pixel circuit 30B can be preset to a definite potential before data writing.

Figure 5:
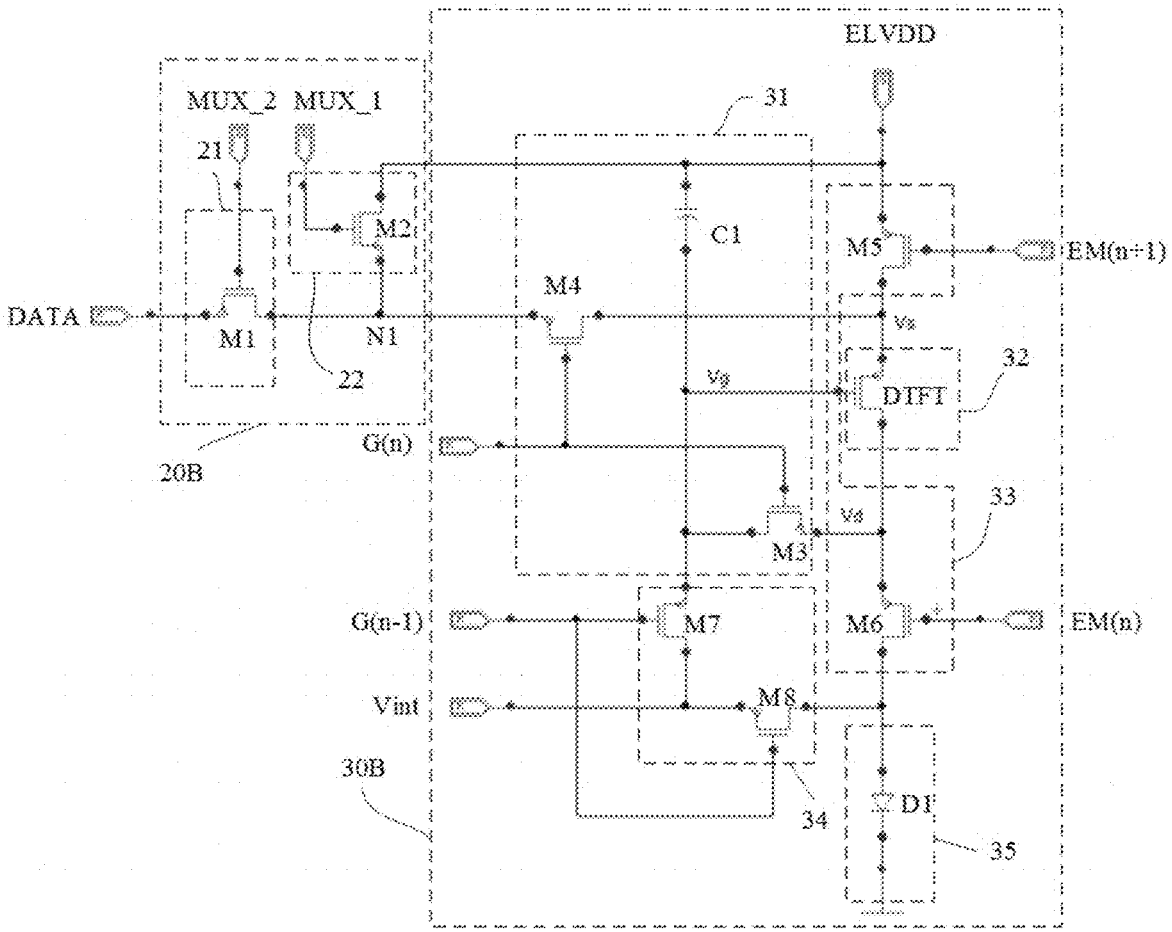
FIG. 5 is a circuit schematic diagram of an example of the multiplexing circuit and the pixel circuit of FIG. 3.

FIG. 5 is a circuit schematic diagram of an example of the multiplexing circuit 20B and the pixel circuit 30B of FIG. 3. As shown in FIG. 5, the pixel circuit 30B includes a compensating sub-circuit 31, a driving sub-circuit 32, a light emission control sub-circuit 33, a reset sub-circuit 34, and a light emission sub-circuit 35.

The light emission sub-circuit 35 is configured to emit light in response to a driving current flowing therethrough during a light emission phase. Specifically, in this example, the light emission sub-circuit 35 includes an organic light emitting diode D1 including an anode configured to receive the driving current and a cathode configured to receive a ground voltage.

The driving sub-circuit 32 is configured to generate the driving current during the light emission phase. The driving current has a magnitude related to the data voltage. Specifically, in this example, the driving sub-circuit 32 includes a driving transistor DTFT including a control electrode, a first electrode, and a second electrode.

The compensation sub-circuit 31 is configured to transfer the data voltage (transferred by the multiplexing control circuit 21 of the multiplexing circuit 20B from the data line DATA to the first node N1) to the driving sub-circuit 32 in response to a second scan signal G(n) being active in a compensation phase. Specifically, in this example, the compensation sub-circuit 31 includes a first capacitor C1, a third transistor M3, and a fourth transistor M4. The first capacitor C1 is connected between the power supply terminal ELVDD and the control electrode of the driving transistor DTFT. The third transistor M3 includes a control electrode configured to receive the second scan signal G(n), a first electrode connected to the second electrode of the driving transistor DTFT, and a second electrode connected to the control electrode of the driving transistor DTFT. The fourth transistor M4 includes a control electrode configured to receive the second scan signal G(n), a first electrode connected to the first node N1, and a second electrode connected to the first electrode of the driving transistor DTFT.

The light emission control sub-circuit 33 is configured to direct the driving current to the light emission sub-circuit 35 in response to a first light emission control signal EM(n) and a second light emission control signal EM(n+1) being active during a light emission phase. Specifically, in this example, the light emission control sub-circuit 33 includes a fifth transistor M5 and a sixth transistor M6. The fifth transistor M5 includes a control electrode configured to receive the second light emission control signal EM(n+1), a first electrode connected to the power supply terminal ELVDD, and a second electrode connected to the first electrode of the driving transistor DTFT. The sixth transistor M6 includes a control electrode configured to receive the first light emission control signal EM(n), a first electrode connected to the second electrode of the driving transistor DTFT, and a second electrode connected to the anode of the organic light emitting diode of D1.

The reset sub-circuit 34 is configured to reset the driving sub-circuit 32 and the light emission sub-circuit 35 with a reset voltage Vint in response to a first scan signal G(n−1) being active during a reset phase. Specifically, in this example, the reset sub-circuit 34 includes a seventh transistor M7 and an eighth transistor M8. The seventh transistor M7 includes a control electrode configured to receive the first scan signal G(n−1), a first electrode connected to the control electrode of the driving transistor DTFT, and a second electrode configured to receive the reset voltage Vint. The eighth transistor M8 includes a control electrode configured to receive the first scan signal G(n−1), a first electrode configured to receive the reset voltage Vint, and a second electrode connected to the anode of the organic light emitting diode D1.

It will be understood that the pixel circuit 30B in FIG. 5 is exemplary, and that in other embodiments the pixel circuit 30 may have a different structure. It will further be understood that although the driving transistor DTFT and the first to eighth transistors M1, M2, . . . , and M8 are shown as P-type transistors in the example of FIG. 5, N-type transistors may be used in other embodiments. In either case, these transistors may typically be fabricated such that their first electrodes (e.g., sources) and second electrodes (e.g., drains) are symmetrical and thus can be used interchangeably. As used herein, the phrase "a signal being active" means that the signal has such a voltage level that the circuit element involved (e.g., a transistor) is enabled. In contrast, the phrase "a signal being inactive" means that the signal has such a voltage level that the circuit element involved (e.g., a transistor) is disabled.

Figure 6:
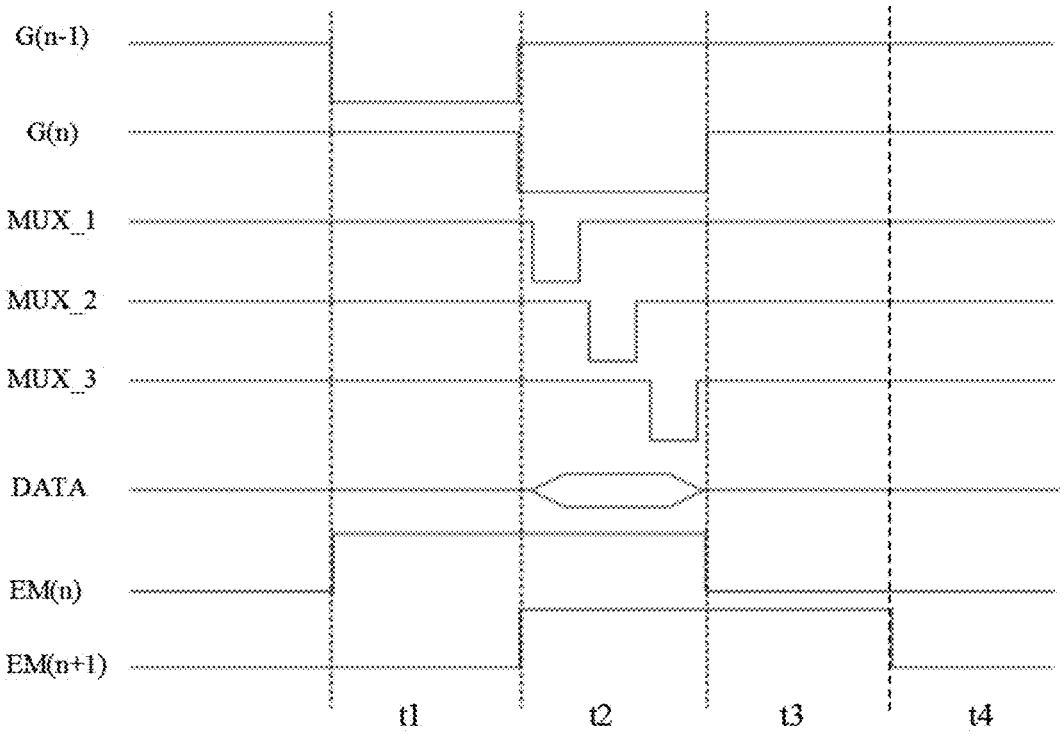
FIG. 6 is a timing diagram of the circuit of FIG. 5.

FIG. 6 is a timing diagram of the circuit of FIG. 5. Assume that the pixel circuits 30A and 30C of FIG. 3 have the same configurations as those of the pixel circuit 30B of FIG. 5, the operations of the pixel driving circuit 10A of FIG. 3 can be described below with reference to FIGS. 3, 5, and 6.

In a reset phase t1, the first scan signal G(n−1) and the second light emission control signal EM(n+1) are active (at a low level in this example), the second scan signal G(n) and the first light emission control signal EM(n) are inactive (at a high level in this example), and the multiplexing control signals MUX_1, MUX_2, and MUX_3 are all inactive. The reset sub-circuits 34 of the pixel circuits 30A, 30B, and 30C simultaneously reset the driving sub-circuits 31 and the light emission sub-circuits 35 of the pixel circuits 30A, 30B, and 30C with the reset voltage Vint.

Specifically, in each of the pixel circuits 30A, 30B, and 30C, the seventh transistor M7 is turned on, and the reset voltage Vint resets the gate voltage Vg of the driving transistor DTFT through the seventh transistor M7, so that Vg=Vint. The reset voltage Vint further charges the first capacitor C1. The eighth transistor M8 is also turned on, and the reset voltage Vint resets the anode voltage of the OLED D1 through the eighth transistor M6. The fifth transistor M5 is turned on, and the power supply voltage Vdd received at the power supply terminal ELVDD resets the source voltage Vs of the driving transistor DTFT through the fifth transistor M5, so that Vs=Vdd. Thereby, the gate-source voltage of the driving transistor DTFT is Vgs=Vint−Vdd.

In a compensation phase t2, the first scan signal G(n−1), the second light emission control signal EM(n+1), and the first light emission control signal EM(n) are all inactive, the second scan signal G(n) is active, and the multiplexing control signals MUX_1, MUX_2, and MUX_3 become active in sequence. The multiplexing control circuits 21 of the multiplexing circuits 20A, 20B, and 20C sequentially couple the data line DATA to the first nodes N1 of the pixel circuits 30A, 30B, and 30C, so that respective data voltages are sequentially transferred to the driving sub-circuits 32 of the pixel circuits 30A, 30B and 30C.

First, the multiplexing control signal MUX_1 becomes active, and the multiplexing control signals MUX_2 and MUX_3 are both inactive. The first transistor M1 of the multiplexing circuit 20A is turned on, and the data voltage Vdata on the data line DATA is transferred to the first node N1 of the pixel circuit 30A. In the pixel circuit 30A, the driving transistor DTFT, the third transistor M3, and the fourth transistor M4 are all turned on, so that the data voltage Vdata charges the first capacitor C1 until the gate voltage of the driving transistor DTFT is Vg=Vdata+Vth, wherein Vth is the threshold voltage of the driving transistor DTFT. This is so-called threshold voltage compensation. At the same time, the second transistor M2 of the multiplexing circuit 20B is turned on, and the first node N1 of the pixel circuit 30B is reset to the power supply voltage Vdd received by the power supply terminal ELVDD. In the pixel circuit 30B, the power supply voltage Vdd charges the first capacitor C1 through the fourth transistor M4, the driving transistor DTFT, and the third transistor M3 until the gate voltage of the driving transistor DTFT is Vg=Vdd+Vth, and the source voltage of the driving transistor DTFT is Vs=Vdd. Thereby, the gate-source voltage of the driving transistor DTFT of the pixel circuit 30B before data writing is Vgs=Vth.

Second, the multiplexing control signal MUX_2 becomes active, and the multiplexing control signals MUX_1 and MUX_3 are both inactive. The first transistor M1 of the multiplexing circuit 20B is turned on, and the data voltage Vdata on the data line DATA (which may be different from the data voltage when the multiplexing control signal MUX_1 is active) is transferred to the first node N1 of the pixel circuit 30B. In the pixel circuit 30B, the driving transistor DTFT, the third transistor M3, and the fourth transistor M4 are all turned on, so that the data voltage Vdata charges the first capacitor C1 until the gate voltage of the driving transistor DTFT is Vg=Vdata+Vth. At the same time, the second transistor M2 of the multiplexing circuit 20C is turned on, and the first node N1 of the pixel circuit 30C is reset to the power supply voltage Vdd received by the power supply terminal ELVDD. In the pixel circuit 30C, the power supply voltage Vdd charges the first capacitor C1 through the fourth transistor M4, the driving transistor DTFT, and the third transistor M3 until the gate voltage of the driving transistor DTFT is Vg=Vdd+Vth, and the source voltage of the driving transistor DTFT is Vs=Vdd. Thereby, the gate-source voltage of the driving transistor DTFT of the pixel circuit 30C before data writing is Vgs=Vth.

Finally, the multiplexing control signal MUX_3 becomes active, and both MUX_1 and MUX_2 are inactive. The first transistor M1 of the multiplexing circuit 20C is turned on, and the data voltage Vdata on the data line DATA is transferred to the first node N1 of the pixel circuit 30C. In the pixel circuit 30C, the driving transistor DTFT, the third transistor M3, and the fourth transistor M4 are all turned on, so that the data voltage Vdata charges the first capacitor C1 until the gate voltage of the driving transistor DTFT is Vg=Vdata+Vth.

In a waiting phase t3, the first scan signal G(n−1), the second light emission control signal EM(n+1), and the first scan signal G(n) are all inactive, the first light emission control signal EM(n) is active, and the multiplexing control signals MUX_1, MUX_2, and MUX_3 are all inactive. In each of the pixel circuits 30A, 30B, and 30C, the sixth transistor M6 is turned on, and the OLED D1 waits for light emission.

In a light emission phase t4, the first scan signal G(n−1) and the second scan signal G(n) are both inactive, the second light emission control signal EM(n+1) and the first light emission control signal EM(n) are active, and the multiplexing control signals MUX_1, MUX_2, and MUX_3 are all inactive. The light emission control sub-circuits 33 of the pixel circuits 30A, 30B, and 30C simultaneously direct respective driving currents to the respective light emission sub-circuits 35 of the pixel circuits 30A, 30B, and 30C such that the light emission sub-circuits 35 simultaneously emit light.

Specifically, in each of the pixel circuits 30A, 30B, and 30C, the sixth transistor M6 and the fifth transistor M5 are turned on, so that the driving current generated by the driving transistor DTFT can flow through the OLED D1. Then, the OLED D1 starts to emit light.

Figure 7:
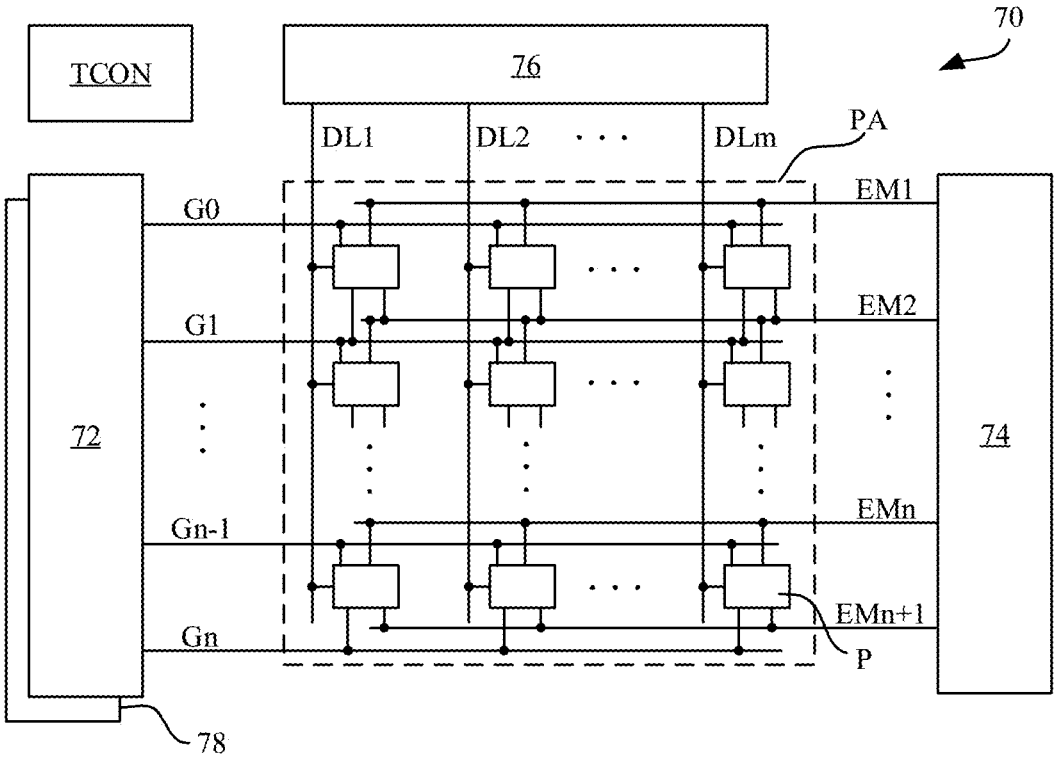
FIG. 7 is a schematic block diagram of a display device in accordance with an embodiment of the present disclosure.

FIG. 7 is a schematic block diagram of a display device 70 in accordance with an embodiment of the present disclosure. Referring to FIG. 7, the display device 70 includes an array substrate PA, a first scan driver 72, a second scan driver 74, a data driver 76, a multiplexing scan driver 78, and a timing controller TCON.

The array substrate PA includes a plurality of pixel driving circuits P arranged in an array. Each of the plurality of pixel driving circuits P may take the form of any of the embodiments of the pixel driving circuit 10 described above. The array substrate PA includes n+1 first scan lines G0, G1, . . . , Gn−1 and Gn arranged in a row direction to transfer gate scanning signals, n+1 second scan lines EM1, EM2, . . . , EMn and EMn+1 arranged in the row direction to transfer light emission control signals, m data lines DL1, DL2, . . . , DLm arranged in a column direction to transfer voltage signals, signal lines (not shown) for supplying multiplexing control signals from the multiplexing scan driver 78 to the pixel driving circuits P, and wires (not shown) for supplying power supply voltages to the pixel driving circuits P. n and m are natural numbers.

The timing controller TCON is used to control the first scan driver 72, the second scan driver 74, the data driver 76, and the multiplexing scan driver 78. The timing controller TCON receives input image data and input control signals from a system interface. The input image data may include a plurality of input pixel data for the plurality of pixels. Each of the plurality of input pixel data may include red gradation data R, green gradation data G, and blue gradation data B for a respective one of the plurality of pixels. The input control signals may include a main clock signal, a data enable signal, a vertical sync signal, a horizontal sync signal, and the like. The timing controller TCON generates output image data, a first control signal, a second control signal, a third control signal, and a fourth control signal based on the input image data and the input control signals.

The output image data may be compensated image data generated by compensating the input image data using a compensation algorithm. The output image data is supplied to the data driver 76.

The first, second, third, and fourth control signals are supplied to the first scan driver 72, the second scan driver 74, the data driver 76, and the multiplexing scan driver 78, respectively. The first, second, and fourth control signals may include a vertical enable signal, a gate clock signal, and the like. The third control signal may include a horizontal enable signal, a data clock signal, a data load signal, and the like.

The first scan driver 72 generates a plurality of gate scan signals based on the first control signal. The plurality of gate scan signals are supplied to the first scan lines G0, G1, . . . , Gn−1 and Gn.

The second scan driver 74 generates a plurality of light emission control signals based on the second control signal. The plurality of light emission control signals are supplied to EM1, EM2, . . . , EMn and EMn+1.

The data driver 76 generates a plurality of data voltages based on the third control signal and the output image data. The plurality of data voltages are supplied to the data lines DL1, DL2, . . . , DLm.

The multiplexing scan driver 78 generates a plurality of multiplexing control signals based on the fourth control signal. For example, in the case of the pixel driving circuit 10A of FIG. 3, the multiplexing scan driver 78 generates the three multiplexing control signals MUX_1, MUX_2, and MUX_3 (FIG. 6) for each row of pixel driving circuits.

The first scan driver 72, the second scan driver 74, the data driver 76, the multiplexing scan driver 78, and the timing controller TCON can be implemented with a general purpose processor, a digital signal processors (DSP), an application specific integrated circuit (ASIC), a field programmable gate array (FPGA) or other programmable logic devices, discrete gates or transistor logics, discrete hardware components, or any combination thereof designed to perform the functions described herein. The general purpose processor may be a microprocessor, but in an alternative, the processor may be a conventional processor, a controller, a microcontroller, or a state machine. The processor may also be implemented as a combination of computing devices, such as a combination of a DSP and a microprocessor, a plurality of microprocessors, one or more microprocessors in combination with a DSP core, or any other such configurations.

By way of example and not limitation, the display device 70 may be any product or component having a display function, such as a cell phone, a tablet, a television, a display, a notebook, a digital photo frame, a navigator, and the like.

The display device 70 has the same advantages as those of the pixel driving circuit embodiments described above, and will not be described herein any further.

Variations to the disclosed embodiments can be understood and effected by the skilled person in practicing the claimed subject matter, from a study of the drawings, the disclosure, and the appended claims. In the claims, the word "comprises" or "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. A pixel driving circuit, comprising:

N pixel circuits, each of the pixel circuits comprising a first node and a power supply terminal, the first node configured to receive a data voltage, the power supply terminal configured to receive a power supply voltage, wherein N is an integer greater than 1; and N multiplexing circuits configured to selectively couple a data line to the first nodes of the N pixel circuits, wherein a first one of the N multiplexing circuits comprises a multiplexing control circuit, and a second one to an N-th one of the N multiplexing circuits comprise respective multiplexing control circuits and respective reset circuits, wherein the multiplexing control circuit of an i-th one of the N multiplexing circuits is configured to couple the data line to the first node of an i-th one of the N pixel circuits in response to an i-th multiplexing control signal being active, i being an integer and $1 \leq i \leq N$, and the reset circuit of a (j+1)-th one of the N multiplexing circuits is configured to reset the first node of a (j+1)-th one of the N pixel circuits with the power supply voltage in response to a j-th multiplexing control signal being active, j being an integer and $1 \leq j < N$.

2. The pixel driving circuit of claim 1, wherein the multiplexing control circuits of the N multiplexing circuits are configured such that the data line is sequentially coupled to the first nodes of the N pixel circuits.

3. The pixel driving circuit of claim 1, wherein the multiplexing control circuit of the i-th one of the N multiplexing circuits comprises a first transistor comprising:

a control electrode configured to receive the i-th multiplexing control signal;

a first electrode connected to the data line; and a second electrode connected to the first node of the i-th one of the N pixel circuits.

4. The pixel driving circuit of claim 1, wherein the reset circuit of the (j+1)-th one of the N multiplexing circuits comprises a second transistor comprising:

a control electrode configured to receive the j-th multiplexing control signal;

a first electrode connected to the first node of the (j+1)-th one of the N pixel circuits; and a second electrode connected to the power supply terminal of the (j+1)-th one of the N pixel circuits.

5. The pixel driving circuit of claim 1, wherein each of the N pixel circuits comprises a compensation sub-circuit, a driving sub-circuit, a light emission control sub-circuit, a reset sub-circuit, and a light emission sub-circuit, wherein the reset sub-circuit is configured to reset the driving sub-circuit and the light emission sub-circuit with a reset voltage in response to a first scan signal being active during a reset phase, the compensation sub-circuit is configured to transfer the data voltage at the first node to the driving sub-circuit in response to a second scan signal being active during a compensation phase, the driving sub-circuit is configured to generate a driving current during a light emission phase, the driving current having a magnitude related to the data voltage, the light emission control sub-circuit is configured to direct the driving current to the light emission sub-circuit in response to a first light emission control signal and a second light emission control signal being active during the light emission phase, and the light emission sub-circuit is configured to emit light in response to the driving current flowing therethrough during the light emission phase.

6. The pixel driving circuit of claim 5, wherein the light emission sub-circuit comprises an organic light emitting diode comprising an anode configured to receive the driving current and a cathode configured to receive a ground voltage.

7. The pixel driving circuit of claim 6, wherein the driving sub-circuit comprises a driving transistor comprising a control electrode, a first electrode and a second electrode.

8. The pixel driving circuit of claim 7, wherein the compensation sub-circuit comprises:

a third transistor comprising a control electrode configured to receive the second scan signal, a first electrode connected to the second electrode of the driving transistor, and a second electrode connected to the control electrode of the driving transistor;

a fourth transistor comprising a control electrode configured to receive the second scan signal, a first electrode connected to the first node, and a second electrode connected to the first electrode of the driving transistor; and a first capacitor connected between the power supply terminal and the control electrode of the driving transistor.

9. The pixel driving circuit of claim 8, wherein the light emission control sub-circuit comprises:

a fifth transistor comprising a control electrode configured to receive the second light emission control signal, a first electrode connected to the power supply terminal, and a second electrode connected to the first electrode of the driving transistor; and a sixth transistor comprising a control electrode configured to receive the first light emission control signal, a first electrode connected to the second electrode of the driving transistor, and a second electrode connected to the anode of the organic light emitting diode.

10. The pixel driving circuit of claim 9, wherein the reset sub-circuit comprises:

a seventh transistor comprising a control electrode configured to receive the first scan signal, a first electrode connected to the control electrode of the driving transistor, and a second electrode configured to receive the reset voltage; and an eighth transistor comprising a control electrode configured to receive the first scan signal, a first electrode configured to receive the reset voltage, and a second electrode connected to the anode of the organic light emitting diode.

11. A display device comprising a plurality of the pixel driving circuits as recited in claim 1.

12. The display device of claim 11, wherein the multiplexing control circuits of the N multiplexing circuits are configured such that the data line is sequentially coupled to the first nodes of the N pixel circuits.

13. The display device of claim 11, wherein the multiplexing control circuit of the i-th one of the N multiplexing circuits comprises a first transistor comprising:

a control electrode configured to receive the i-th multiplexing control signal;

a first electrode connected to the data line; and a second electrode connected to the first node of the i-th one of the N pixel circuits.

14. The display device of claim 11, wherein the reset circuit of the (j+1)-th one of the N multiplexing circuits comprises a second transistor comprising:

a control electrode configured to receive the j-th multiplexing control signal;

a first electrode connected to the first node of the (j+1)-th one of the N pixel circuits; and a second electrode connected to the power supply terminal of the (j+1)-th one of the N pixel circuits.

15. The display device of claim 11, wherein each of the N pixel circuits comprises a compensation sub-circuit, a driving sub-circuit, a light emission control sub-circuit, a reset sub-circuit, and a light emission sub-circuit, wherein the reset sub-circuit is configured to reset the driving sub-circuit and the light emission sub-circuit with a reset voltage in response to a first scan signal being active during a reset phase, the compensation sub-circuit is configured to transfer the data voltage at the first node to the driving sub-circuit in response to a second scan signal being active during a compensation phase, the driving sub-circuit is configured to generate a driving current during a light emission phase, the driving current having a magnitude related to the data voltage, the light emission control sub-circuit is configured to direct the driving current to the light emission sub-circuit in response to a first light emission control signal and a second light emission control signal being active during the light emission phase, and the light emission sub-circuit is configured to emit light in response to the driving current flowing therethrough during the light emission phase.

16. The display device of claim 15, wherein the light emission sub-circuit comprises an organic light emitting diode comprising an anode configured to receive the driving current and a cathode configured to receive a ground voltage.

17. A method of driving a pixel driving circuit, wherein the pixel driving circuit comprises: N pixel circuits, each of the pixel circuits comprising a first node and a power supply terminal, the first node configured to receive a data voltage, the power supply terminal configured to receive a power supply voltage, wherein N is an integer greater than 1; and N multiplexing circuits configured to selectively couple a data line to the first nodes of the N pixel circuits, wherein a first one of the N multiplexing circuits comprises a multiplexing control circuit, and a second one to an N-th one of the N multiplexing circuits comprise respective multiplexing control circuits and respective reset circuits, wherein the multiplexing control circuit of an i-th one of the N multiplexing circuits is configured to couple the data line to the first node of an i-th one of the N pixel circuits in response to an i-th multiplexing control signal being active, i being an integer and $1 \leq i \leq N$, and the reset circuit of a (j+1)-th one of the N multiplexing circuits is configured to reset the first node of a (j+1)-th one of the N pixel circuits with the power supply voltage in response to a j-th multiplexing control signal being active, j being an integer and $1 \leq j < N$, the method comprising:

supplying the j-th multiplexing control signal that is active to the multiplexing control circuit of a j-th one of the N multiplexing circuits such that the data voltage on the data line is transferred to the first node of a j-th one of the N pixel circuits, and that the first node of the (j+1)-th one of the N pixel circuits is reset to the power supply voltage.

18. The method of claim 17, wherein each of the N pixel circuits comprises a compensation sub-circuit, a driving sub-circuit, a light emission control sub-circuit, a reset sub-circuit, and a light emission sub-circuit, the method further comprising:

performing a reset phase in which the reset sub-circuit resets the driving sub-circuit and the light emission sub-circuit with a reset voltage;

performing a compensation phase in which the compensation sub-circuit transfers the data voltage at the first node to the driving sub-circuit; and performing a light emission phase in which the driving sub-circuit generates a driving current having a magnitude related to the data voltage, the light emission control sub-circuit directs the driving current to the light emission sub-circuit, and the light emission sub-circuit emits light in response to the driving current flowing therethrough, wherein the supplying of the j-th multiplexing control signal that is active to the multiplexing control circuit of the j-th one of the N multiplex circuits is performed in the compensation phase.

19. The method of claim 18, wherein the performing the compensation phase further comprises:

sequentially coupling, by the multiplexing control circuits of the N multiplexing circuits, the data line to the first nodes of the N pixel circuits such that respective data voltages are sequentially transferred to the driving sub-circuits of the N pixel circuits.

20. The method of claim 19, wherein in the reset phase, the reset sub-circuits of the N pixel circuits simultaneously reset the driving sub-circuits and the light emission sub-circuits of the N pixel circuits; and in the light emission phase, the light emission control sub-circuits of the N pixel circuits simultaneously direct respective driving currents to the light emission sub-circuits of the N pixel circuits such that the light emission sub-circuits simultaneously emit light.

* * * * *